US008047862B2

(12) United States Patent
Lilie et al.

(10) Patent No.: US 8,047,862 B2
(45) Date of Patent: Nov. 1, 2011

(54) MOUNTING ARRANGEMENT FOR AN ELECTRIC SUPPLY CABLE HAVING A CONNECTOR WITH A SEALING RING AND LOCKING MEANS

(75) Inventors: Dietmar Erich Bernhard Lilie, Joinville-Sc (BR); Claudio Roberto Hille, Joinville-Sc (BR); Ilario Jose Scheuer, Joinville-Sc (BR); Marcos Giovani Bortoli, Joinville-Sc (BR); Manfred Krueger, Joinville-Sc (BR); Emilio Rodrigues Huelse, Joinville (BR)

(73) Assignee: Whirlpool S.A., Sao Paulo -Sp (BR)

( * ) Notice: Subject to any disclaimer, the term of this patent is extended or adjusted under 35 U.S.C. 154(b) by 0 days.

(21) Appl. No.: 12/935,067

(22) PCT Filed: Mar. 30, 2009

(86) PCT No.: PCT/BR2009/000086

§ 371 (c)(1),
(2), (4) Date: Dec. 2, 2010

(87) PCT Pub. No.: WO2009/121153

PCT Pub. Date: Oct. 8, 2009

(65) Prior Publication Data

US 2011/0092089 A1 Apr. 21, 2011

(30) Foreign Application Priority Data

Mar. 31, 2008 (BR) ..... 0801086

(51) Int. Cl.
*H01R 13/52* (2006.01)
*H01R 13/40* (2006.01)

(52) U.S. Cl. ..... 439/271; 439/587

(58) Field of Classification Search ..... 439/884, 439/66, 500, 83, 62, 282, 278, 680, 685, 439/566, 926, 930, 935, 350, 353, 271–275, 439/519, 587–588; 174/262, 260, 152 GM
See application file for complete search history.

(56) References Cited

U.S. PATENT DOCUMENTS 4,684,190 A * 8/1987 Clark et al. ..... 439/587
4,687,272 A * 8/1987 Spinner et al. ..... 439/271
(Continued)

FOREIGN PATENT DOCUMENTS

DE 19947831 A1 4/2000
(Continued)

*Primary Examiner* — Chandrika Prasad
(74) *Attorney, Agent, or Firm* — Gifford, Krass, Sprinkle, Anderson & Citkowski, P.C.

(57) ABSTRACT

The mounting arrangement is applied to a refrigeration compressor having a shell (1) externally carrying energizing pins (2) and comprises: a connector (10) to be mounted to the shell (1) and having a non-electric conducting base body (11) which houses and retains electric terminals (4) attached to an electric supply cable (3) and which are designed to fit said energizing pins (2), one of the parts of shell (1) and base body (11) of the connector (10) carrying locking means (20) to be engaged to respective locking receiving means (30) provided in the other part, when the connector (11) is mounted to the shell (1); and an elastic sealing means (40) carried by one of the parts of shell (1) and connector (11) and to be pressed between said parts, around the energizing pins (2), when the connector (11) is mounted to the shell (1).

9 Claims, 9 Drawing Sheets

U.S. PATENT DOCUMENTS

| | | | | |
|---|---|---|---|---|
| 5,044,986 | A | 9/1991 | Baumanis | |
| 5,584,716 | A | 12/1996 | Bergman | |
| 7,553,186 | B2 * | 6/2009 | Morikawa et al. | 439/587 |
| 2006/0270262 | A1 * | 11/2006 | Schmidt et al. | 439/271 |
| 2006/0292927 | A1 * | 12/2006 | Burris et al. | 439/587 |
| 2008/0318473 | A1 * | 12/2008 | Morikawa et al. | 439/588 |

FOREIGN PATENT DOCUMENTS

| | | | |
|---|---|---|---|
| WO | WO-2006058396 | A2 | 6/2006 |
| WO | WO-2006131140 | A1 | 12/2006 |

* cited by examiner

MOUNTING ARRANGEMENT FOR AN ELECTRIC SUPPLY CABLE HAVING A CONNECTOR WITH A SEALING RING AND LOCKING MEANS

FIELD OF THE INVENTION

The present invention refers to a mounting arrangement for attaching an electric supply cable in a hermetic refrigeration compressor, of the type which comprises a shell carrying outer energizing pins, said cable being operatively associated with a connector to be mounted to the shell and having a base body, housing electric terminals attached to the electric supply cable and which are designed to be fitted in said energizing pins.

BACKGROUND OF THE INVENTION

Refrigeration compressors present, mounted in the hermetic shell thereof, a hermetic terminal having energizing pins externally projecting from the shell and to which is coupled a cable to supply electric energy to the compressor motor housed in the interior of the hermetic shell, said electric supply cable being connected to an electric power source external to the compressor.

In a known solution, the electric supply cable is mounted to the hermetic terminal, by means of electric terminals, generally housed in an electric insulation core. Moreover, in order to protect the user against electric shocks, the electric insulation core that involves the electric terminals is covered by a connector body made in an electric insulating material and which is removably locked, by engaging means, to a supporting structure welded to the compressor shell, in the region adjacent to the hermetic terminal which carries the energizing pins. In these known constructions, the supporting structure welded to the hermetic shell is configured to provide only one locking receiving means designed to receive and retain a single locking means provided in the connector body or cover, the dimensioning and positioning of the supporting structure of both the locking receiving means and locking means being made within determined tolerances, to guarantee the desired stability to the seating and retention of the connector to the shell, with the electric terminals being safely fitted in the respective energizing pins. Since the parts involved in the desired mounting coupling are rigid or substantially rigid, any dimensional deviation will cause the connector to remain electrically coupled to the energizing pins, but in a position in which it is not adequately pressed against the shell of the compressor, making this mounting susceptible to vibrations during the operation of the compressor and also permitting humidity to penetrate between the connector and the shell, towards the energizing pins, with potential risks of causing undesirable short circuits and electric contacts.

Apart from the deficiency mentioned above in relation to the known mounting arrangements, the connector has its body designed to receive the electric supply cable according to an axial direction coincident with that of the energizing pins, requiring a larger space for mounting the compressor so as to accommodate the electric supply cable extension axially projecting from the connector.

Another negative aspect of the known mounting arrangements results from the fact that the connectors do not define a means that can provide an adequate and safe mechanical retention of the electric supply cable in the connector body.

OBJECTS OF THE INVENTION

It is an object of the present invention to provide a mounting arrangement for an electric supply cable in a refrigeration compressor of the type described above, with a simple construction and which guarantees not only an electrically and mechanically safe retention of the connector to the shell, but also a high degree of protection for the electric contact elements against humidity.

Another object of the present solution is to provide a mounting arrangement such as cited above and which allows a safe mechanical retention of the electric supply cable to the connector body, in a positioning orthogonal to the axial direction of the energizing pins, reducing the space required for accommodating said electric supply cable in the mounting place of the compressor.

SUMMARY OF THE INVENTION

The mounting arrangement for an electric supply cable in a refrigeration compressor, object of the present invention, is applied to a refrigeration compressor of the type which comprises a shell, which externally carries energizing pins and a connector to be mounted to the shell and having a non-electric conducting base body, housing and retaining electric terminals attached to an electric supply cable and which are designed to be fitted in the energizing pins, one of the parts of shell and connector base body carrying locking means to be engaged in respective locking receiving means provided in the other part, when the connector is mounted to the shell. The arrangement of the present invention comprises an elastic sealing means, carried by one of the parts of shell and connector, to be pressed between said parts around the energizing pins when the connector is mounted to the shell, by engaging the locking means to the locking receiving means.

Other advantageous characteristics of the present arrangement will become evident with the description of the invention presented below.

BRIEF DESCRIPTION OF THE DRAWINGS

The invention will be described below with reference to the enclosed drawings, given by way of example of an embodiment of the invention and in which.

DESCRIPTION OF THE ILLUSTRATED EMBODIMENT

Figure 1:
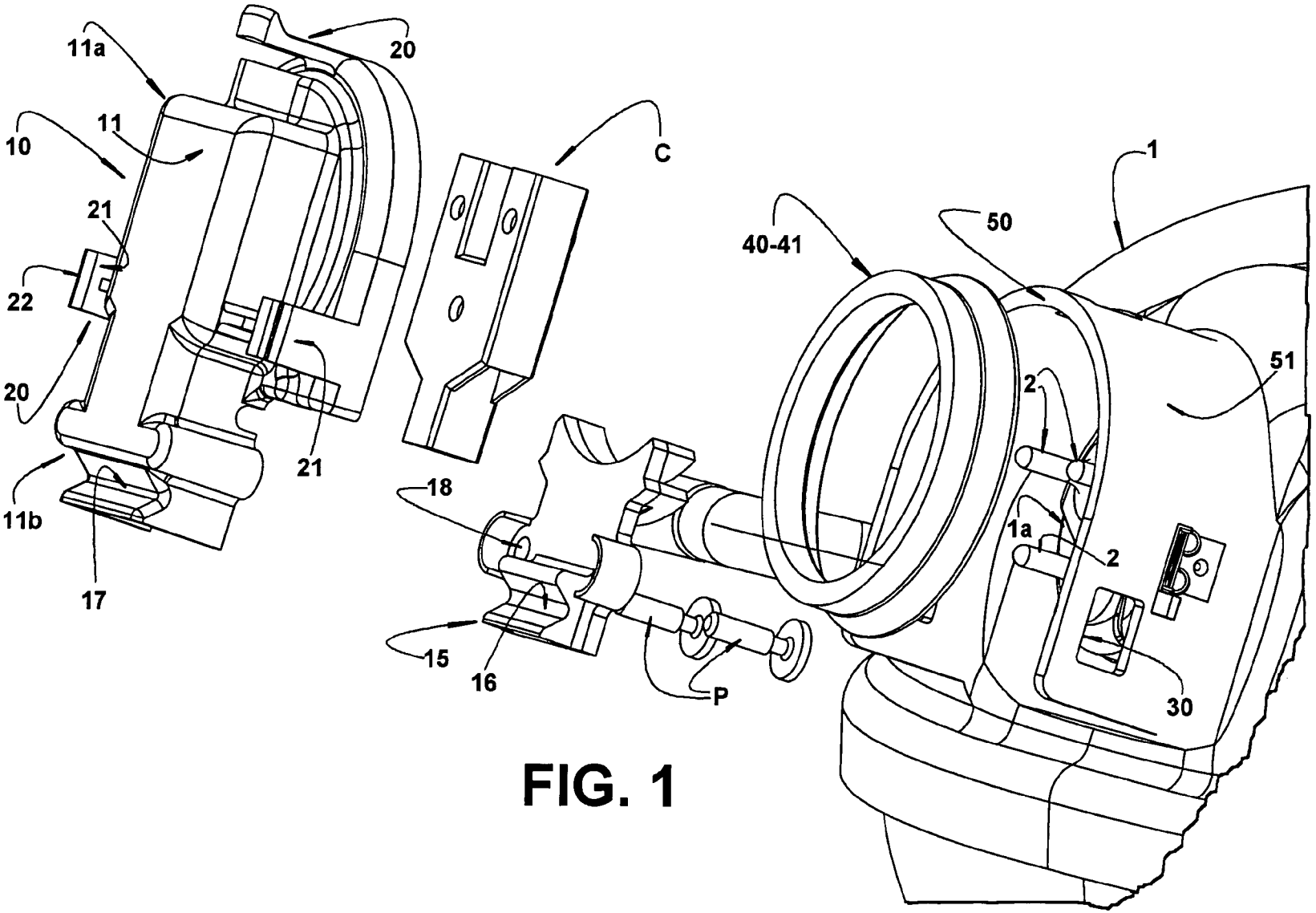
FIG. 1 represents an exploded perspective view of the assembly formed by a connector, an electric supply cable and a sealing means of the mounting arrangement of the present invention, and positioned in relation to a hermetic shell of a compressor.
Figure 2:
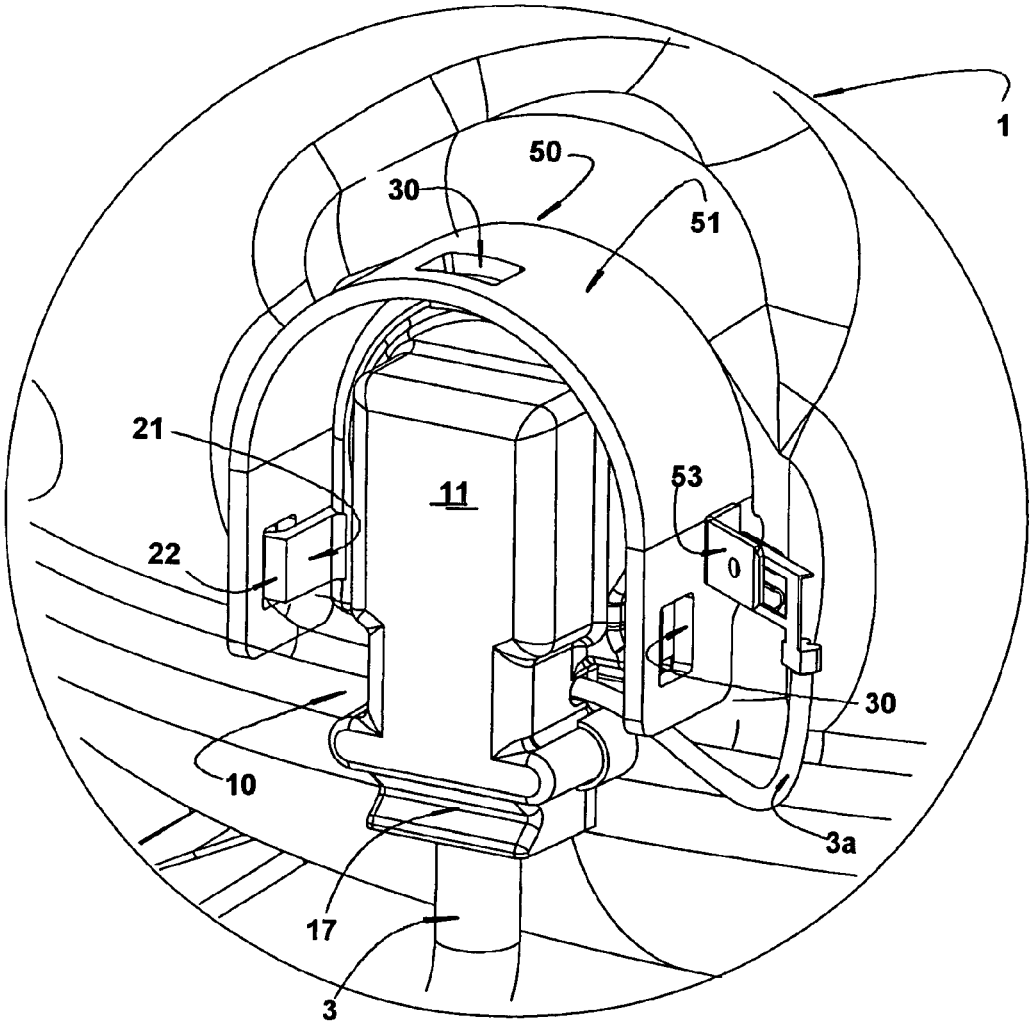
FIG. 2 represents a perspective view of the assembly of FIG. 1, the electric supply cable being coupled to the hermetic terminal of the compressor, by means of the mounting arrangement of the present invention.

The present invention refers to a mounting arrangement for an electric supply cable in a refrigeration compressor comprising, in the interior of a hermetic shell 1, an electric motor (not illustrated), electrically coupled to a hermetic terminal 1*a* including generally three energizing pins 2 carried by the shell 1, outwardly projecting from the latter, and through which said electric motor is energized from an electric power source external to the compressor (not illustrated). The compressor is coupled to the electric power source by means of an electric supply cable 3, having an end provided with electric terminals 4 of adequate construction and to be coupled to the hermetic terminal 1*a* of the shell 1 of the compressor, and another end (not illustrated) electrically coupled to said electric power source.

The electric supply cable 3 is coupled to the hermetic terminal 1*a* in the shell 1 of the compressor, through a connector 10, to be mounted to the shell 1 and having a non-electric conducting base body 11 which houses and retains the electric terminals 4 affixed to the adjacent end of the electric supply cable 3 and which are designed to be fitted in said energizing pins 2. One of the parts of shell 1 and base body 11 of the connector 10 carries locking means 20 which are elastically deformable, between a locking position and a releasing position, to be engaged in respective locking receiving means 30 provided in the other part, when the connector 10 is mounted to the shell 1, said locking means 20 being removably engaged to the locking receiving means 30 upon mounting the base body 11 of the connector 10 to the energizing pins 2, in order to lock said parts against displacements that may cause detachment of the base body in relation to the shell 1 and of the electric terminals 4 in relation to the energizing pins 2.

In the illustrated constructive form, the electric terminals 4 are housed in a terminal body C, in a Y-shaped non-electric conducting material, usually used for electrically connecting the electric supply cable 3 to hermetic refrigeration compressors and which is mounted and retained in the interior of the base body 11 of the connector 10 or incorporated thereto in a single piece. However, it should be understood that the present solution can be applied to any construction of electric terminals 4, which construction is not relevant to the invention. In a constructive variant in which the connector 10 is obtained in a single piece, the base body is formed to house the electric terminals 4, this construction not presenting the Y-shaped terminal body C. The mounting arrangement of the present invention comprises an elastic sealing means 40 carried by one of the parts of shell 1 and connector 10 and to be pressed therebetween, around the energizing pins 2, when the connector 10 is mounted to the shell 1, by engaging the locking means 20 to the locking receiving means 30.

According to the embodiment illustrated, the elastic sealing means 40 is defined by an elastic ring 41, for example, in an elastomeric material, mounted in a channel 12 provided in the part that carries it and projecting outwardly from said channel 12, in order to be pressed and elastically deformed against the other part, upon mounting the connector 10 to the shell 1.

According to the illustrated configuration, the locking means 20 comprise at least two tongues 21, projecting from the part in which they are provided, in a direction parallel to the energizing pins 2, and each incorporating a tooth 22, each respective locking receiving means 30 being provided with a stop 31, carried by the other part and against which is seated the tooth 22 of a respective tongue 21 in the locking position, each tooth 22 being forced against the respective stop 31, by action of the elastic sealing means 40 pressed between the connector 10 and the shell 1. Each stop 31 is defined by a recess 32 provided in the part that carries the locking receiving means 30, as described ahead.

In a way of carrying out the present invention, the locking receiving means 30 is provided in a supporting means 50, projecting from the respective part and which can be defined, for example, by a supporting plate 51, the stop 31 which constitutes the locking receiving means 30, being defined by a front edge of a window 52 provided in said supporting plate 51. In the illustrated constructive example, the locking receiving means 30 is provided in a supporting means 50 affixed to the shell 1, generally by welding, and projecting from the latter.

The supporting plate 51 presents an inverted U-shaped contour disposed around the energizing pins 2, the tongues 21 of the locking means 20 being incorporated, in a single piece, to the base body 11 of the connector 10. In the illustrated construction, the inverted U-shaped supporting plate 51 has its upper portion curved in a circle arc and one of its side portions externally carrying a support 53 for fitting a ground wire 3*a* of the electric supply cable 3, after mounting the connector 10 to the shell 1.

In order to lock the base body 11 of the connector 10 to the energizing pins 2 according to the present invention, said base body 11 is mounted to the shell 1, to be positioned under the supporting plate 51, which surrounds at least the part of said base body 11 provided with the tongues 21 of the locking means 20, which tongues 21 are fitted and retained against respective stops 31 of the locking receiving means 30 provided in the supporting plate 51.

The base body 11 of the connector 10 presents a substantially parallelepipedic elongated form, having a body upper portion 11*a*, which houses the electric terminals 4, and a body lower portion 11*b*, for retaining the electric supply cable 3. In the illustrated construction, the body upper portion 11*a* houses and retains the terminal body C and defines a substantial part of the circumferential peripheral contour of the channel 12.

Although the illustrated construction presents the channel 12 having only part of its circumferential contour defined in the base body 11, in other possible constructions within the concept presented herein, the channel 12 can be entirely provided in said base body 11 or further, optionally, in another constructive form, in which the channel 12 is carried by the shell 1.

The body upper portion 11*a* carries the tongues 21, which are distributed, along the peripheral extension of said body upper portion 11*a*, symmetrically in relation to the longitudinal axis of the base body 11, so that the forces to attach the connector to the shell 1 are equally distributed.

In the illustrated construction, the locking means comprise a pair of side tongues 21, disposed symmetrically to the longitudinal axis of the base body 11 and adjacently to the region of the body lower portion 11*b*, and a central upper tongue 21 disposed equally spaced from said pair of side tongues 21. Each tongue 21 presents a U-shaped arm extension, axially projecting from the body upper portion 11*a* and which allows said tongue 21 to be submitted to an elastic deformation between the rest position, before introducing the connector 10 under the supporting plate 51, a maximum deflecting position, during the introduction of the tooth of each tongue 21 by the supporting plate 51 and before reaching a respective window 52 of the latter, and an operational deflecting position, forcing the sealing means in the mounted pressed condition against the shell 1. Said operational deflecting position is obtained by seating each tooth 22 against the stop 31 defined by a respective window 52 of the supporting plate 50, which position is maintained by the expansion force of the sealing means 40 during its useful life.

In this construction of base body 11, the electric supply cable 3 is introduced in said base body 11 of the connector 10 according to an orthogonal direction in relation to the axial direction of the energizing pins 2, and has part of its extension, adjacent to its end coupled to the electric terminals 4, seated against the body lower portion 11*b* of said base body 11.

The base body 11 comprises, peripherally and around a cradle portion 11*c* medianly defined in the body upper portion 11*a*, an open circumferential groove 13, which defines part of the circumferential contour of the channel 12 for housing the elastic sealing means 40, in the form of an elastic ring 41. The circumferential complement of said channel 12 is obtained by a groove portion 14 provided in a press-cable 15 to be seated and affixed against the body lower portion 11*b*, for securing the supply cable 3.

It should be understood that the solution of base body 11 of the connector 10 formed in two pieces, one of them housing and retaining the electric terminals 4 and the other being attached to the first one and pressing, against it, the electric supply cable 3, each piece carrying a respective circumferential extension of the channel 12, is not limitative. Although not illustrated herein, the present invention can be carried out with a base body 11 of the connector 10 formed in a single piece and defining the channel 12 for mounting the elastic sealing means 40 in the form of elastic ring 41.

The press-cable 15 comprises a locking tongue 16, which grips the electric supply cable 3 seated on the body lower portion 11*b* of the base body 11. In the illustrated construction, the locking tongue 16 operates together with an inner tongue 17 provided in the body lower portion 11*b* and which acts as a seating stop of the electric supply cable 3.

The press-cable 15 can be attached to the body lower portion 11*b* by any known means (glue, welding screw, rivet, etc.). In the illustrated form, the press-cable 15 is provided with through holes 18, each receiving a respective screw P.

Figure 3:
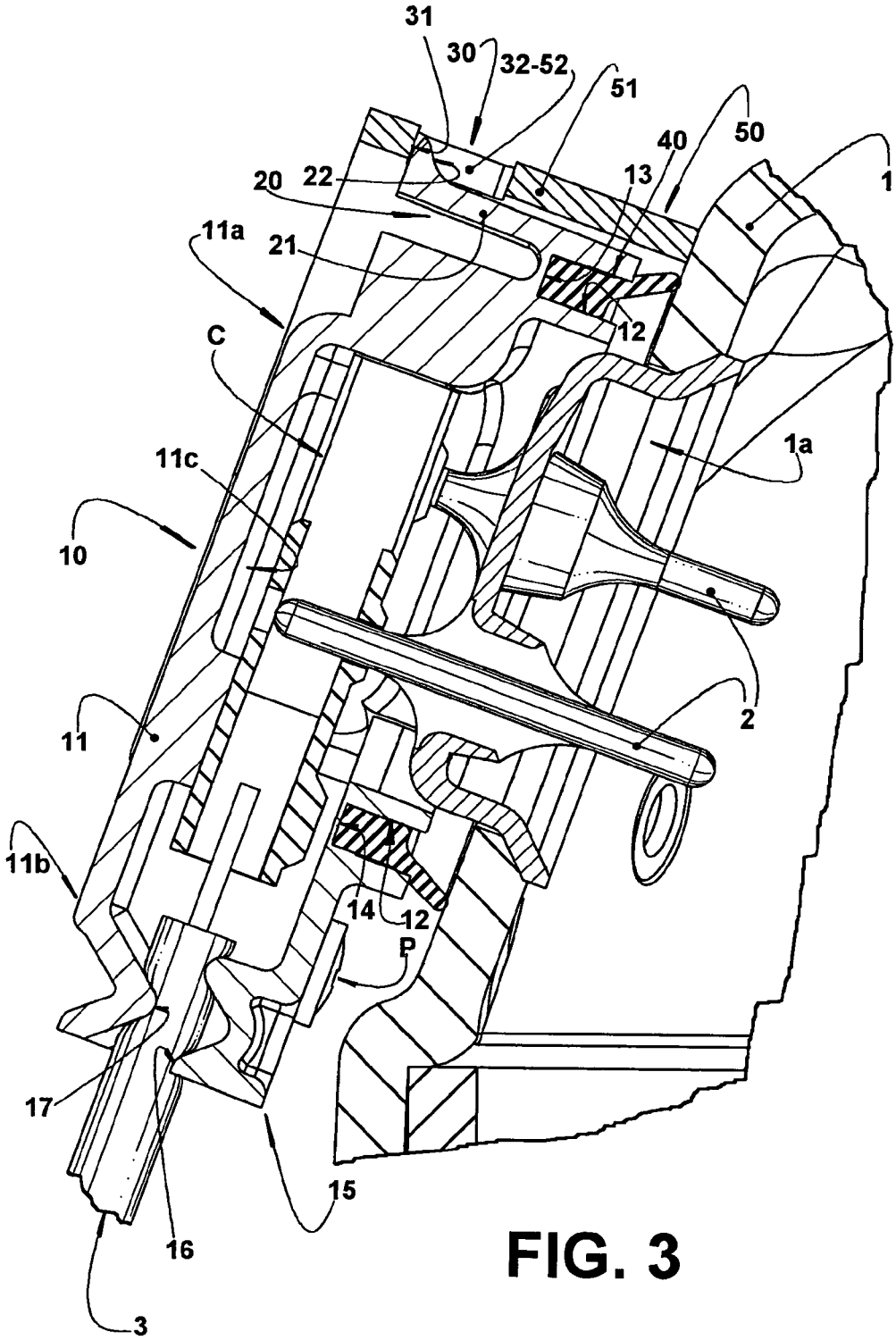
FIG. 3 represents a longitudinal sectional view of the assembly illustrated in FIGS. 1 and 2, showing the connector coupled to the electric supply cable and to the electric terminal of the compressor shell, according to the arrangement illustrated in FIG. 2.
Figure 4:
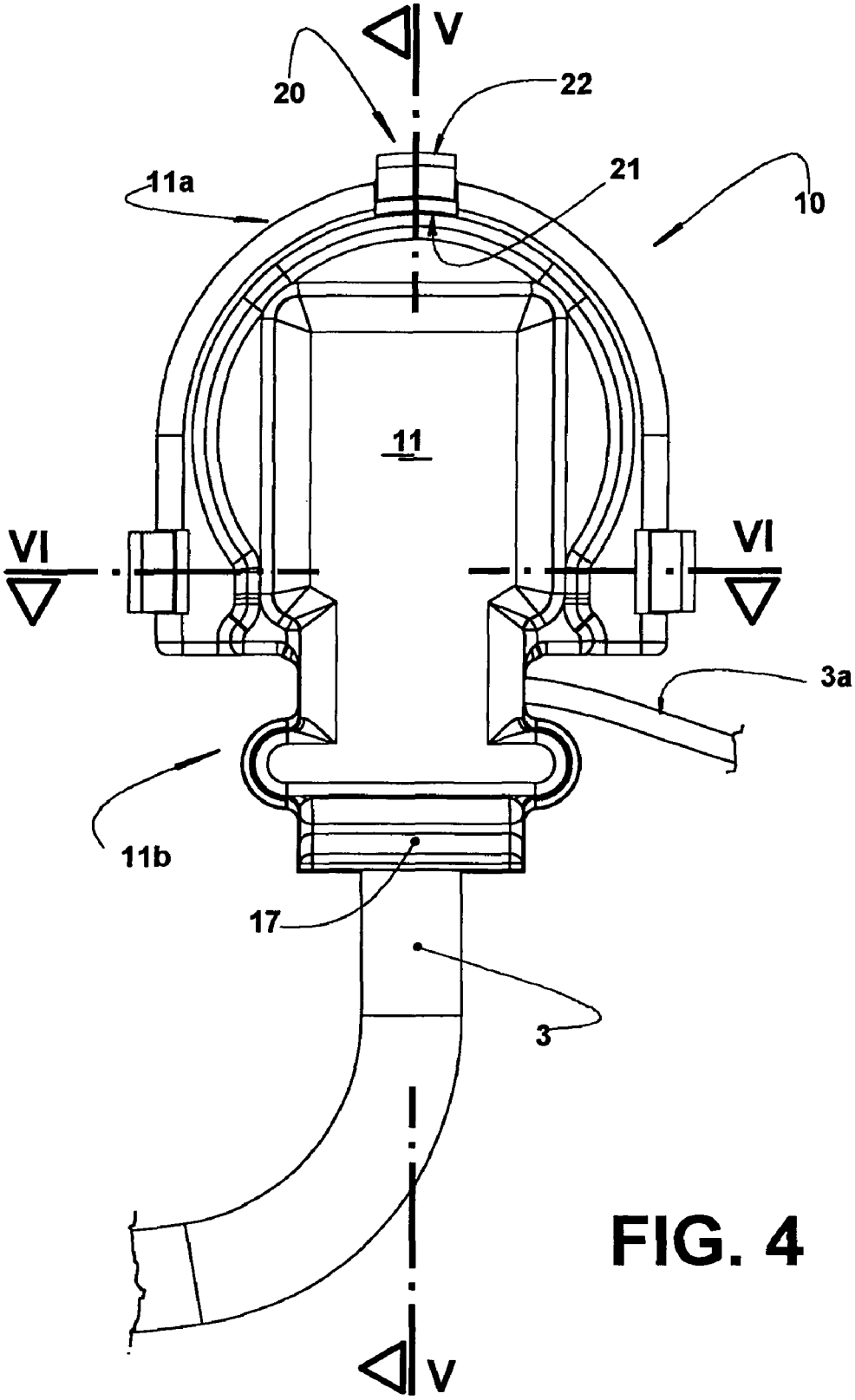
FIG. 4 represents a rear view of the connector body attaching the electric supply cable.
Figure 5:
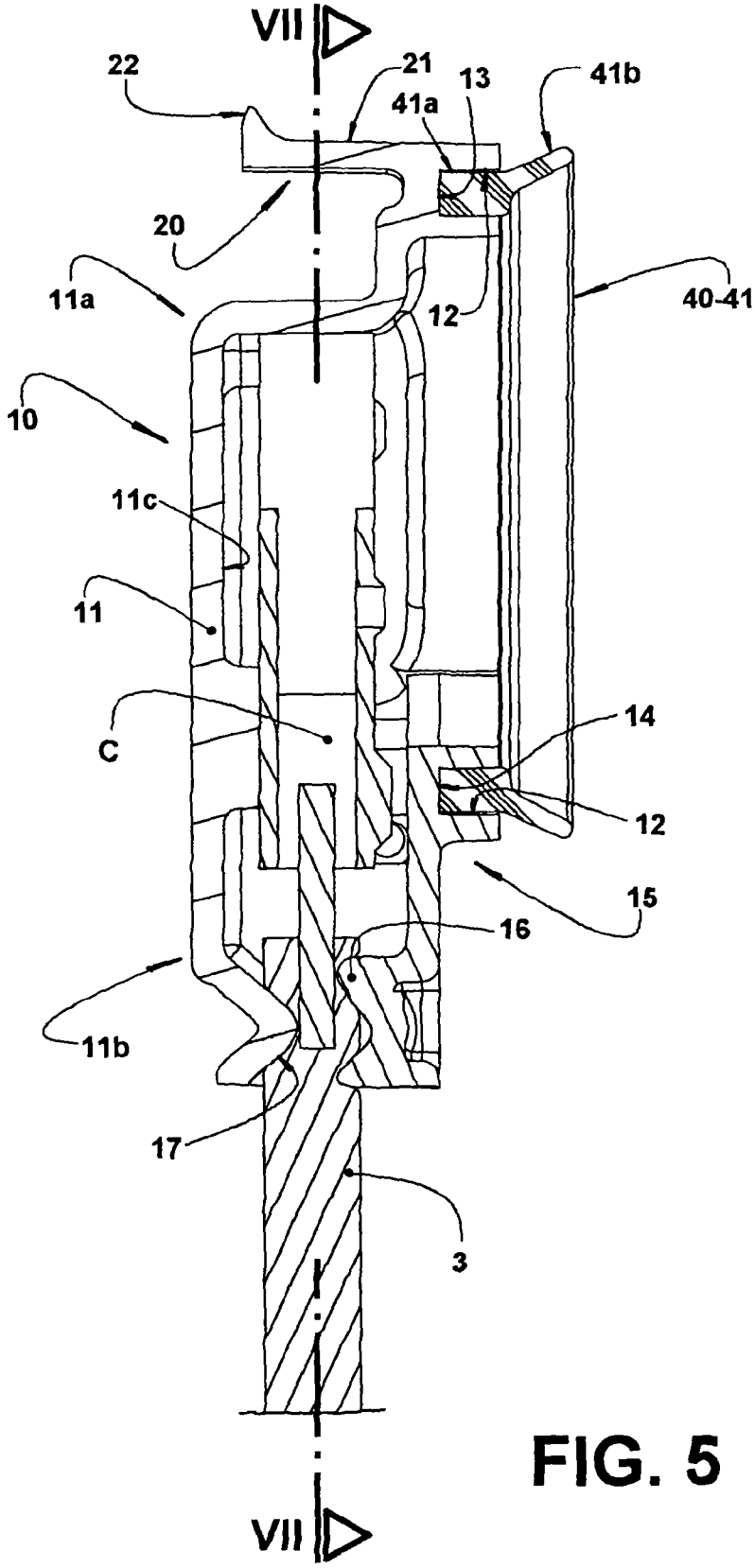
FIG. 5 represents a longitudinal sectional view of the connector body, the electric supply cable and the sealing means, said section taken according to line V-V in FIG. 4.
Figure 6:
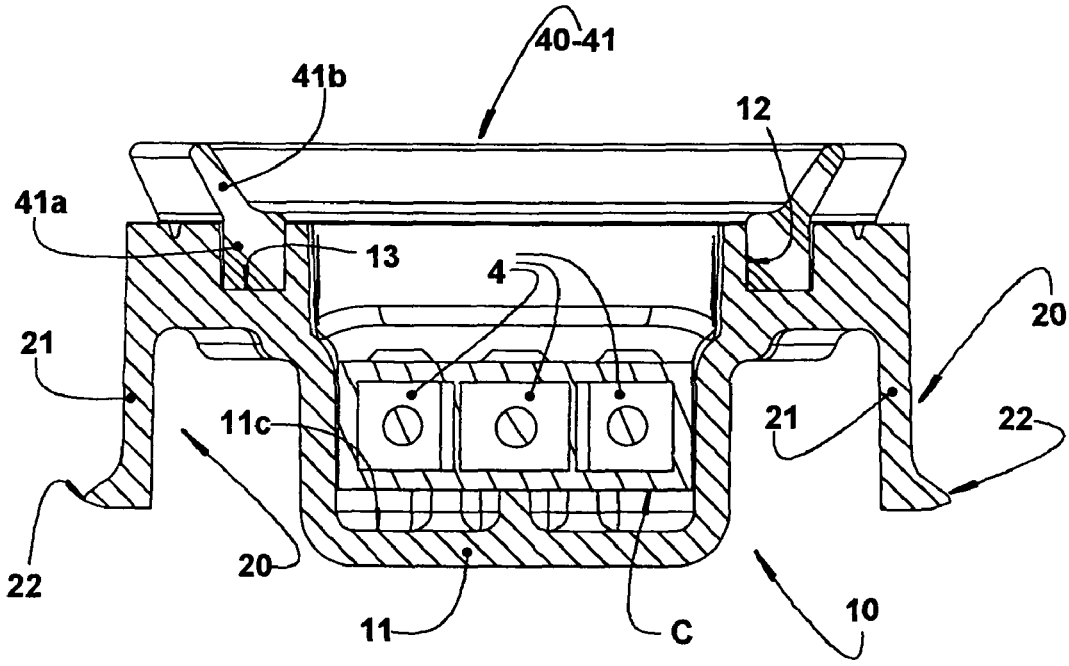
FIG. 6 represents a cross-sectional view of the connector body and the sealing means, said section taken according to line VI-VI in FIG. 4.
Figure 7:
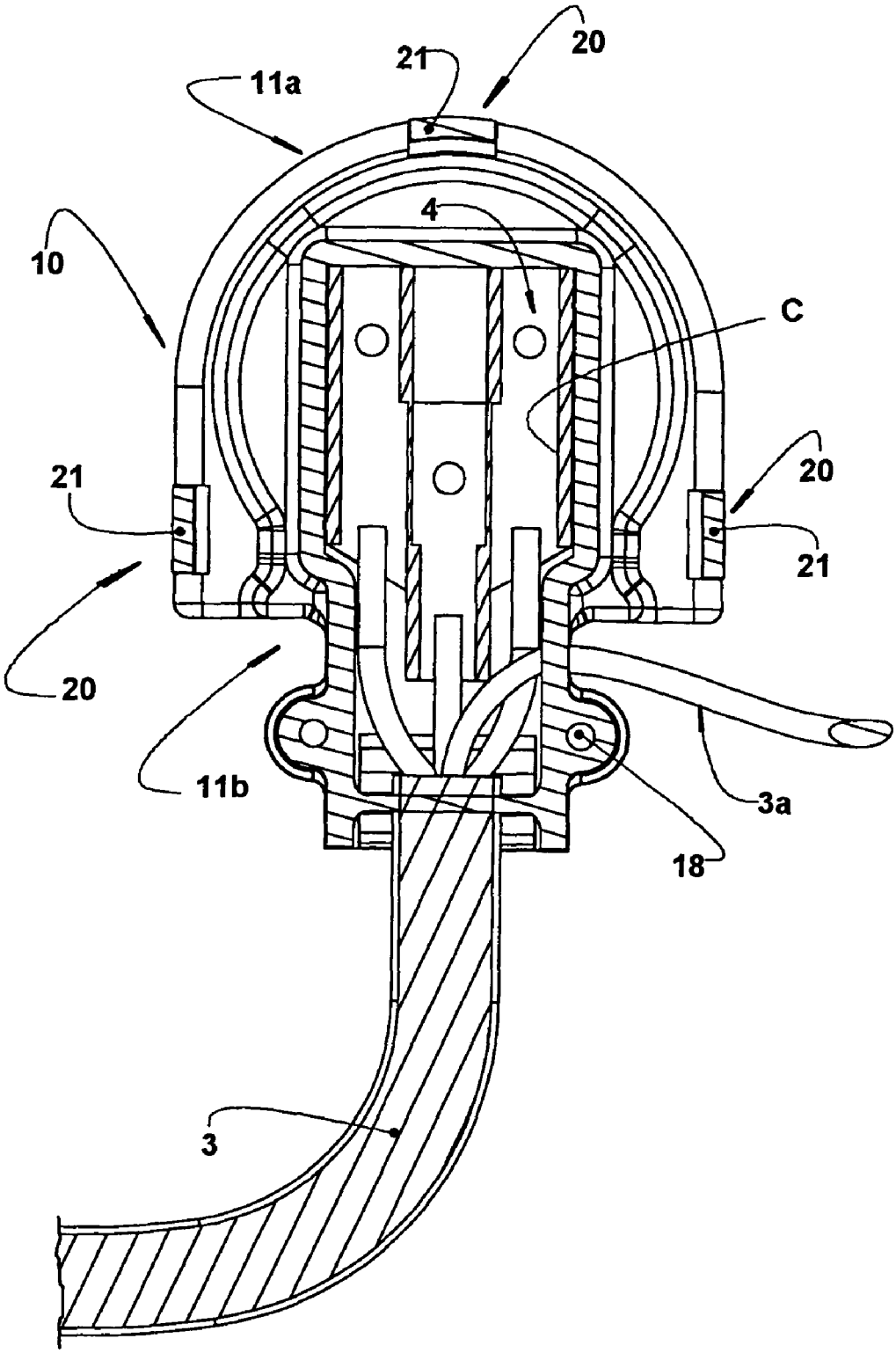
FIG. 7 represents another longitudinal sectional view of the connector body, the electric supply cable and the sealing means, said section taken according to line VII-VII in FIG. 5.
Figure 8:
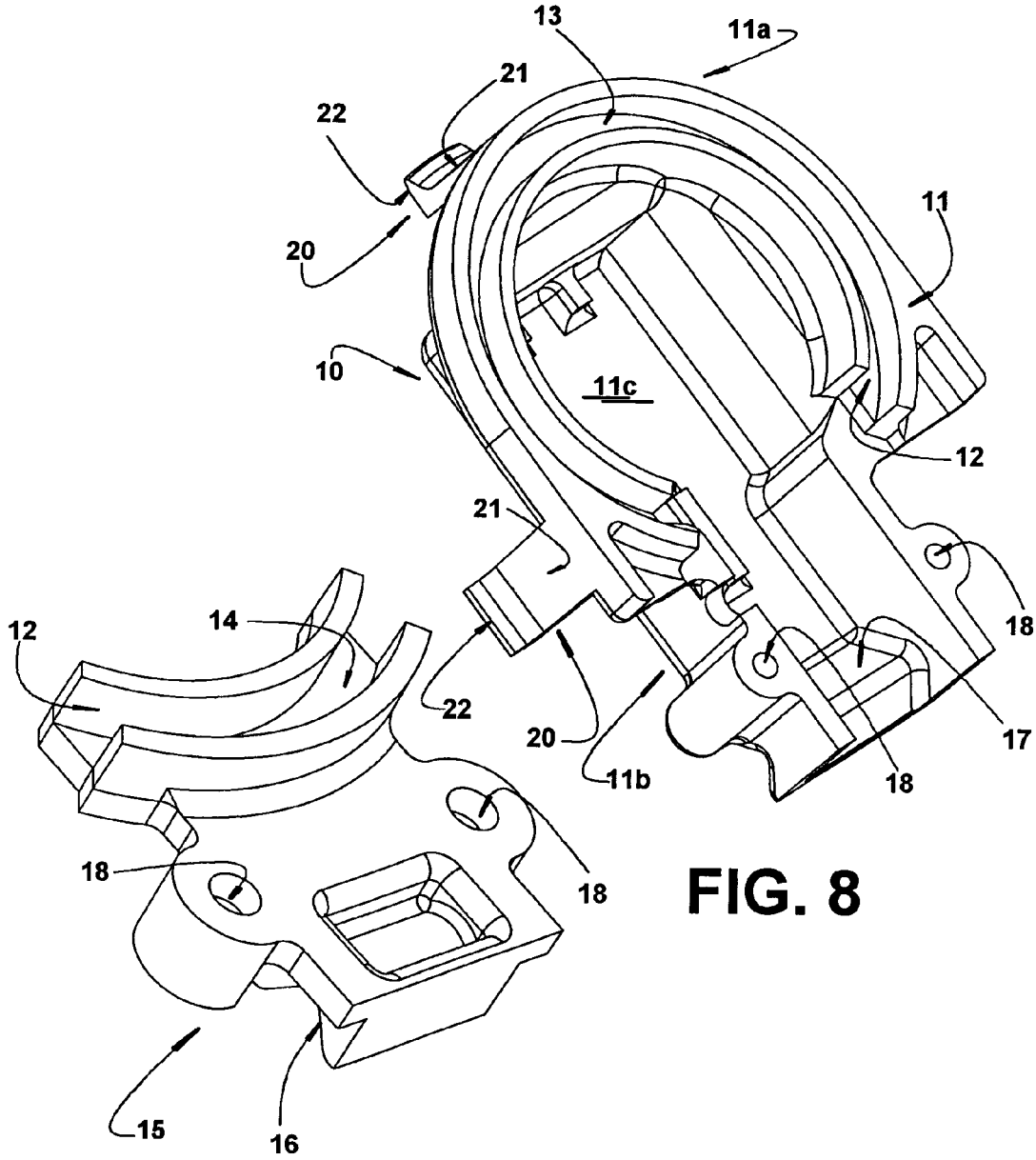
FIG. 8 represents a frontal exploded perspective view of the connector body illustrated in FIG. 1.
Figure 9:
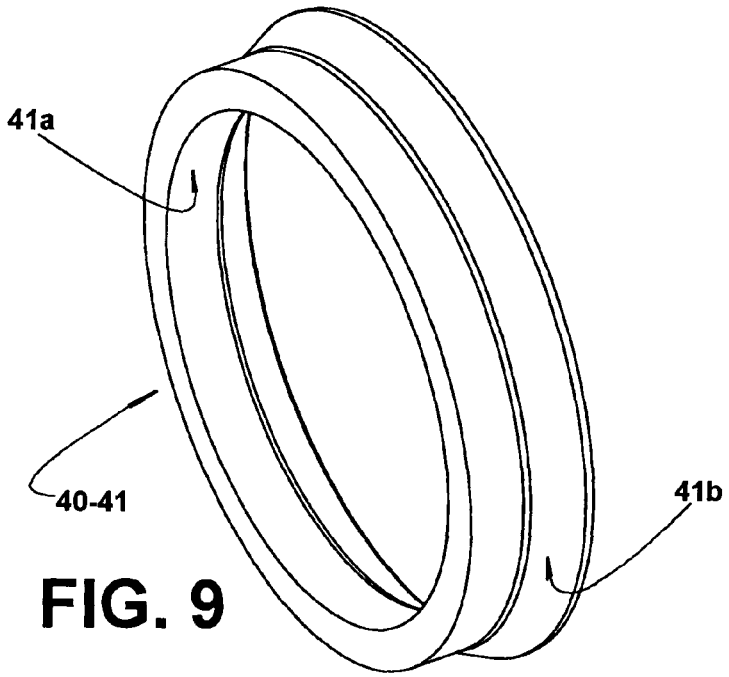
FIGS. 9, 9A and 9B respectively illustrate a perspective view, a plan view, and a sectional-view taken according to line IX-IX in FIG. 9A of the sealing means of the present invention.
Figure 9A:
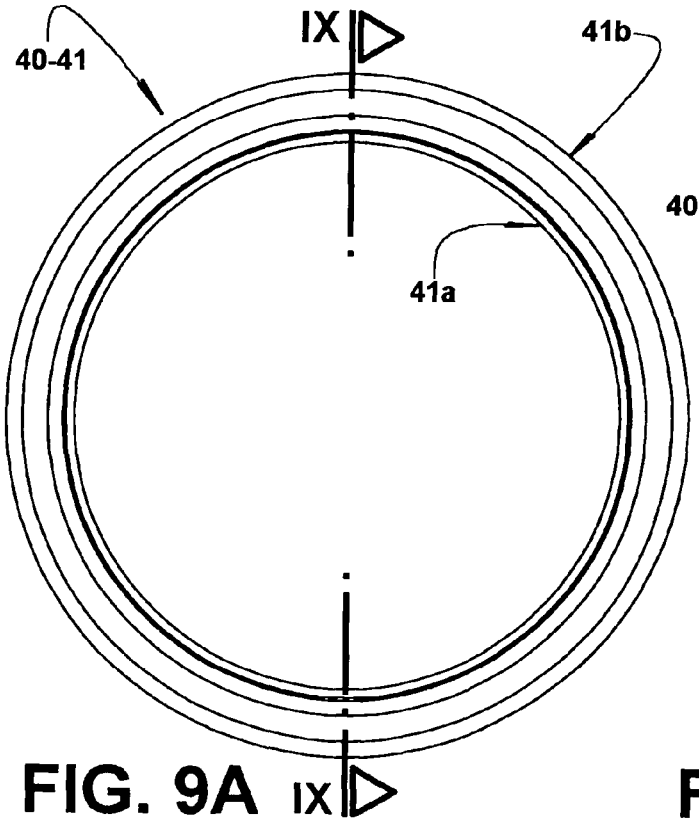
Figure 9B:
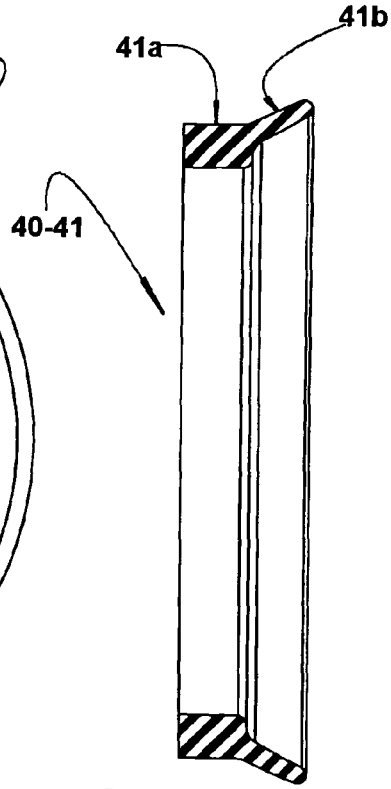

The elastic ring 41 presents a fitting portion 41*a*, to be seated and retained in the interior of the channel 12, and a sealing portion 41*b*, projecting from the fitting portion 41*a* and externally projecting from the channel 12, when said elastic ring 41 is mounted to the latter. In the illustrated constructive form, the sealing portion 41*b* presents a divergent conical form, which is elastically deformable upon locking the connector 10 to the shell 1, as illustrated in FIG. 3.

The proposal of the present invention is to provide a more simple mounting arrangement which requires only the operation of engaging the entire already pre-mounted arrangement in the supporting plate attached to the shell, for example, by means of welding, and which prevents, by using the sealing means, the humidity from entering in the region of the energizing pins 2.

Although only one exemplary form of carrying out the invention has been illustrated herein, it should be understood that alterations can be made in the form, number and arrangement of the different components, without departing from the inventive concept defined in the claims accompanying the present specification.

The invention claimed is:

1. A mounting arrangement for an electric supply cable in a refrigeration compressor of the type which comprises a shell (1) externally carrying energizing pins (2), and a connector (10) to be mounted to the shell (1) and having a non-electric conduction base body (11) which houses and retains electric terminals (4) attached to an electric supply cable (3) and designed to be fitted in said energizing pins (2), said shell (1) and said base body (11) of the connector (10) carrying locking means (20) elastically deformable, between a locking position and a releasing position, to be engaged in respective locking receiving means (30), when the connector (11) is mounted to the shell (1), and further comprising an elastic sealing means (40), in order to be pressed and elastically deformed upon mounting the connector (10) to the shell (1) around the energizing pins (2) when the connector (11) is mounted to the shell (1), by engaging the locking means (20) to the locking receiving means (30), characterized in that the elastic sealing means is in the form of an elastic ring (41) mounted in a channel (12) provided in the connector (10) and projecting outwardly from said channel (12), the locking means (20) comprising at least two tongues (21) to project into said locking receiving means in a direction parallel to the energizing pins (2), and incorporating a tooth (22), each respective locking receiving means (30) being provided with a stop (31) against which is seated the tooth (22) of a respective tongue (21), each tooth (22) being forced against the respective stop (31), by action of the elastic sealing means (40) pressed between the connector (10) and the shell (11).

2. The mounting arrangement, as set forth in claim 1, characterized in that the elastic ring (41) is in an elastomeric material.

3. The mounting arrangement, as set forth in claim 1, characterized in that each stop (31) is defined by a recess (32) provided in the part that carries the locking receiving means (30).

4. The mounting arrangement, as set forth in claim 1, characterized in that the locking receiving means (30) is provided in a supporting means (50) affixed to the shell (1).

5. The mounting arrangement, as set forth in claim 1, characterized in that the supporting means (50) is defined by a supporting plate (51) projecting from the shell (1), each recess (32) being defined by a window (52) provided in the supporting plate (51).

6. The mounting arrangement, as set forth in claim 5, characterized in that the supporting plate (51) presents an inverted U-shaped contour, being provided around the energizing pins (2), the tongues (21) of the locking means (20) being incorporated, in a single piece, to the connector body (10).

7. The mounting arrangement, as set forth in claim 1, characterized in that the electric supply cable (3) is introduced in the base body (11) of the connector (10), according to an orthogonal direction in relation to the axial direction of the energizing pins (2).

8. The mounting arrangement, as set forth in claim 1, characterized in that the base body (11) of the connector (10) is formed in a single piece, in which is provided the channel (12) for mounting the elastic sealing means (40) in the form of elastic ring (41).

9. The mounting arrangement, as set forth in claim 1, characterized in that the base body (11) of the connector (10) is formed in two pieces, one of them housing and retaining the electric terminals (4) and the other being attached to the first and pressing, against it, the electric supply cable (3), each piece carrying a respective circumferential extension of the channel (12).

* * * * *